United States Patent [19]

Hayashida

[11] 4,135,430

[45] Jan. 23, 1979

[54] PIANO HAMMER

[75] Inventor: Hajime Hayashida, Hamamatsu, Japan

[73] Assignee: Nippon Gakki Seizo Kabushiki Kaisha, Japan

[21] Appl. No.: 800,859

[22] Filed: May 26, 1977

[30] Foreign Application Priority Data

May 31, 1976 [JP] Japan ..... 51-69758
May 31, 1976 [JP] Japan ..... 51-69759

[51] Int. Cl.[2] ..... G10C 3/18
[52] U.S. Cl. ..... 84/254; 144/29
[58] Field of Search ..... 84/236, 243, 251, 254, 84/438, 452; 144/29

[56] References Cited

U.S. PATENT DOCUMENTS 1,971 2/1841 Fobes ..... 84/254
585,557 6/1897 Dolge ..... 84/254
622,065 3/1899 Oster ..... 84/254
959,190 5/1910 Young ..... 84/254

FOREIGN PATENT DOCUMENTS 319322 12/1930 United Kingdom ..... 84/254

*Primary Examiner*—Lawrence R. Franklin
*Attorney, Agent, or Firm*—Ostrolenk, Faber, Gerb & Soffen

[57] ABSTRACT

In a coupling construction of a wooden base with a striking head of a piano hammer, at least one gap is left between a longitudinal end of the striking head and the longitudinal end face of the wooden base which serves as a refuge for unexpected deformation of the elastic insert, thereby avoiding separation of the striking head from the wooden base and development of cracks in the wooden base when striking the string.

12 Claims, 10 Drawing Figures

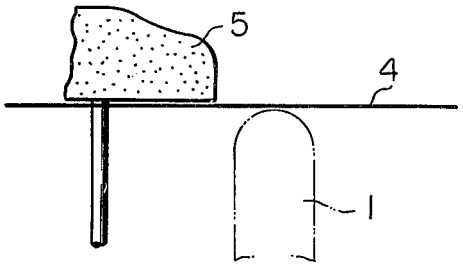
Fig. 1
PRIOR ART
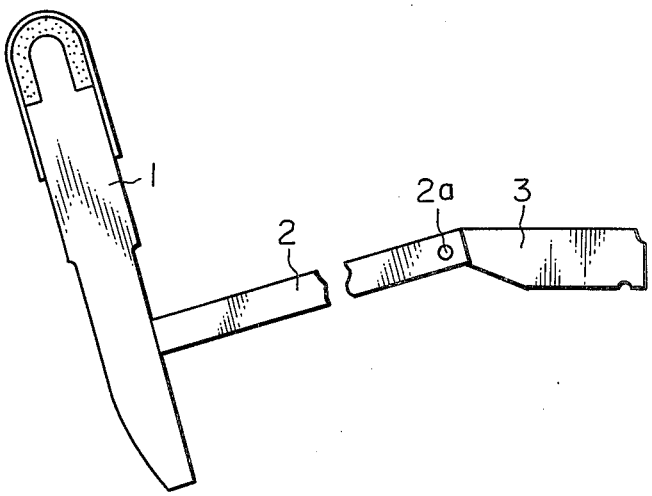
Fig. 2A
PRIOR ART
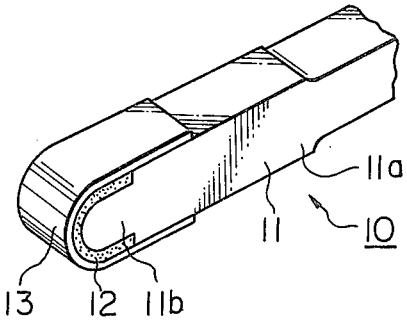

PIANO HAMMER

BACKGROUND OF THE INVENTION

The present invention relates to a piano hammer used for pianos and, especially to a piano hammer of a kind that comprises an elongated hammer base usually made of wood, an elastic striking head coupled to one longitudinal end portion of the wooden base and an outer protective covering that is disposed to the end of the wooden base while it is covering the striking head and more particularly the invention is directed to an improvement in the coupling construction of an elastic striking head with a wooden base of a piano hammer.

The piano hammer of the mentioned kind is particularly suitable for an electric piano and the particulars in design of the component elements thereof vary stepwise from the bass to the treble range of the notes. For a piano hammer that is used over the bass range, the length of the wooden base is long, the weight of the striking head is large, the hardness of the striking head is low and the protective covering is thick. For a piano hammer that is used over the treble range, the length of the wooden base is short, the weight of the striking head is small, the hardness of the striking head is high and the protective covering is thin.

In either case, the coupling between the striking head with the wooden base may be roughly classified into two major types. In one type of coupling, the striking head is disposed to cover a terminal projection having a round end and which is formed on one longitudinal end of the wooden base. In the other type of coupling construction, the striking head is partly received in a recess formed in one longitudinal end of the wooden base.

However, the conventional piano hammer of either type mentioned above has a drawback that the coupling construction affords no refuge for unexpected errors in the size of the striking head and/or of the head receiving portion of the wooden base. The absence of a refuge for unexpected errors in the size of these members easily induces deformation of the striking head which results in undesirable separation of the striking head from the wooden base during manufacturing of the piano hammer and causes the development of cracks in the wooden base when it strikes the respective string in a piano.

In the case of the second type coupling construction, high accuracy is required in the design and manufacturing of the striking head and of the wooden base in order to obtain highly snug coupling of the striking head within the end recess of the wooden base.

SUMMARY OF THE INVENTION

It is a primary object of the present invention to provide an improved piano hammer capable of absorbing errors in size of its component elements and of assuring stable fixation of the elements.

It is another object of the present invention to provide an improved piano hammer which successfully avoids undesirable separation of the component elements even upon unexpected deformation of the elastic insert.

It is another object of the present invention to provide an improved piano hammer which effectively and greatly minimizes the development of cracks in the wooden base at striking the string.

In accordance with the present invention, at least one gap serving as a refuge for errors in the size of the striking head and/or the wooden base is formed between a longitudinal end of the striking head and the longitudinal end face of the wooden base. In a preferred embodiment of the present invention applied to the above-described second type of coupling construction, the end recess is provided with inward convergence and the striking head is provided with corresponding rearward convergence.

BRIEF DESCRIPTION OF THE DRAWINGS

FIG. 1 is an explanatory view showing an arrangement of a piano hammer;

FIG. 2A is a perspective view showing an example of a conventional piano hammer;

DESCRIPTION OF PREFERRED EMBODIMENTS

Figure 2B:
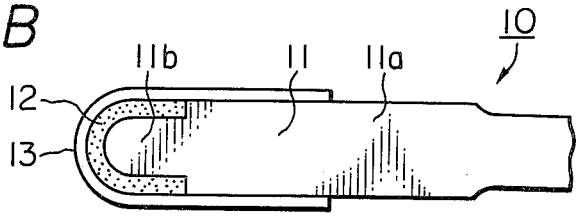
Fig. 2B PRIOR ART
FIGS. 2B and 3 are side views showing the piano hammer of FIG. 2A.

FIG. 1 generally depicts an arrangement of a piano hammer and its related parts in the bass range of a grand piano, the piano being of the type to which the present invention is to be applied as a component thereof. The piano hammer 1 is disposed to one end of a hammer shank 2 and the shank is pivoted at the other end thereof to a rail 3. This arrangement is operationally related to one of the piano keys (not shown) in a conventional manner and, when the associated key is depressed, the piano hammer 1 turns upwardly about the pivot 2*a* of the hammer shank 2 to hit the associated string 4 as shown with a chain line in the drawing. The string 4 is arranged in a tensioned state between the piano hammer 1 and a damper assembly 5.

An example of the conventional piano hammer is shown in FIGS. 2A and 2B, in which the piano hammer 10 includes a wooden base 11 provided with an inwardly stepped projection 11*b* having a round end and extending from the base main body 11*a*. This leaves a longitudinal end surface of the main body 11*a* exposed at the upper and lower sides of the projection. A U-shaped elastic striking head 12 snugly covers and is fixed by bonding to the terminal projection 11*b* of the base 11 and to the end surface of the base main body 11*a*. An outer covering 13 covers the head 12 and a part of the base main body 11*a*. The outer covering 13 is disposed on the head 12 and the base 11 by bonding in order to prevent or to slow degradation and deformation of the striking head after long use of the piano hammer.

Figure 3:
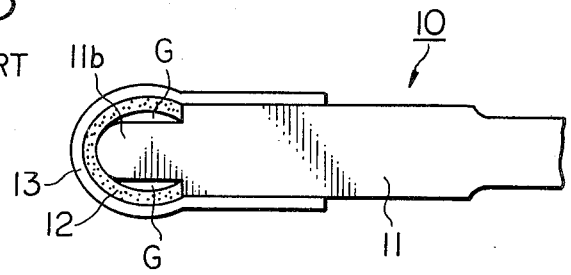
Fig. 3 PRIOR ART

With the above-described construction, the conventional piano hammer is inevitably accompanied with the following drawback. The striking head 12 is in overall snug contact with the terminal projection 11*b* and the end surface of the base main body 11*a*. There is provided no refuge for the striking head 12 when unexpected errors in size of the striking head and/or terminal projection 11*b* occur. Thus, occurrence of unexpected deformation of the elastic insert 12 results in separation of the inside surface of the striking head 12 from the flat outer surface of the terminal projection 11*b* which eventually leads to the development of a thin gap or gaps G between the striking head 12 and the terminal projection 11*b* as shown in FIG. 3.

Generally, in production of piano hammers, a wood plate which is elongated in one longitudinal direction is shaped to have a continuous fringe projection which extends along one side of the plate in the longitudinal direction of the plate. The plate has a transverse cross sectional profile that is similar to the wooden base 11 of the piano hammer shown in FIGS. 2A and 2B. Next, an elongated elastic material striking head and an elongated protective material covering are successively attached by bonding to the wood plate while covering the fringe projection of the plate. After the elements are all combined, the wooden plate with the striking head and the protective covering thereon is cut into individual piano hammers, each of a prescribed width.

The presence of the above-described thin gap or gaps G which develop due to deformation of the striking head in the material state is apt to cause separation of the striking head 12 from the terminal projection 11*b* of the wooden base 11.

Figure 4A:
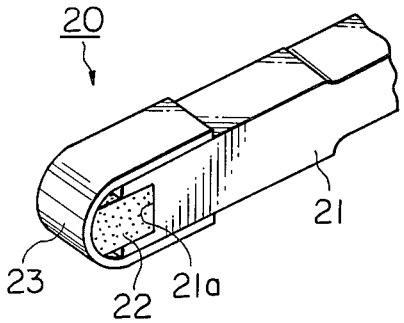
Fig. 4A PRIOR ART
FIG. 4A is a perpective view showing another example of a conventional piano hammer.
Figure 4B:
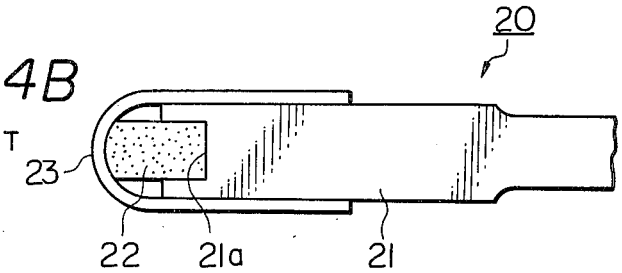
Fig. 4B PRIOR ART
FIG. 4B is a side view of the piano hammer of FIG. 4A.

Another example of a conventional piano hammer is shown in FIGS. 4A and 4B, in which the piano hammer 20 includes a wooden base 21 having a terminal recess 21*a* with a rectangular cross sectional profile (hereinafter referred to as "a rectangular recess"). A striking head 22 is snugly received in and is fixed by bonding in the rectangular recess 21*a* of the wooden base 21. The striking head 22 somewhat projects from the rectangular recess 21*a*. The round end of the striking head is covered by a protective covering 23 which is fixed by bonding to the striking head 22 and to the wooden base 21.

In the piano hammer 20 of this type, high accuracy in size is required for the design and manufacture of the wooden base 21 and the striking head 22 in order to obtain highly snug coupling of the two elements. When the coupling is too tight, striking of the string by the piano hammer tends to develop cracks in the wooden base 21. On the other hand, too loose coupling leaves a gap or gaps along the coupling plane between the two elements, which will surely cause poor bonding between the striking head 22 and the wooden base 21.

Figure 5:
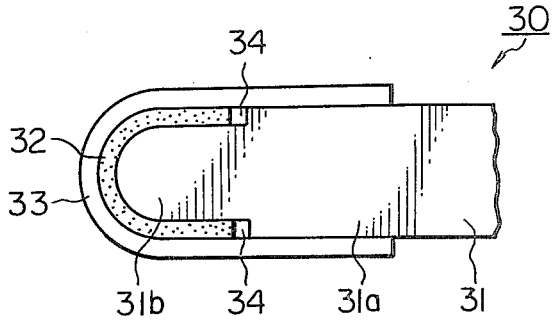
FIG. 5 is a side view showing a piano hammer according to one embodiment of the invention.

One embodiment of the piano hammer in accordance with the present invention is shown in FIG. 5, in which an improvement in accordance with the present invention is applied to a piano hammer of the type shown in FIGS. 2A and 2B.

Like the conventional one, the piano hammer 30 comprises a wooden base 31 having a terminal projection 31*b*, a striking head 32 covering the terminal projection 31*a* and an outer protective covering 33 fixed to the wooden base 31 while covering the striking head 32. The assembly of these elements is substantially similar to that shown in FIGS. 2A and 2B except for the feature that gaps 34 are left between the end faces of the striking head 32 and the end face of the base main body 31*a*. All of this is covered by the covering 33. These gaps 34 function as refuges for possible deformation of the striking head and for the bonding agent used for fixing the elements to each other. The presence of the refuges effectively prevents separation of the striking head 32 from the terminal projection 31*b* which would otherwise be caused by the deformation of the elastic striking head or insert 32. Thus, at manufacturing, the protective covering 33 can be set to the correct position on the wooden base 31 due to absence of separation of the striking head 32 from the wooden base 31. The striking head 32 is made of elastic material such as polyurethane. The protective covering 33 is generally made of a protective material such as deer-skin or artificial leather.

Figure 6:
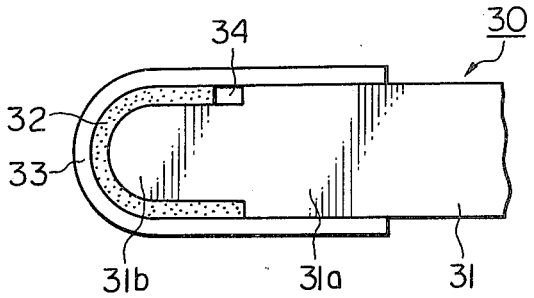
FIGS. 6 through 8 are views showing other embodiments of the invention.

A variant of the embodiment shown in FIG. 5 is shown in FIG. 6, in which the gap 34 is left between only one end face of the striking head 32 and the end face of the base main body 31*a*.

Figure 7:
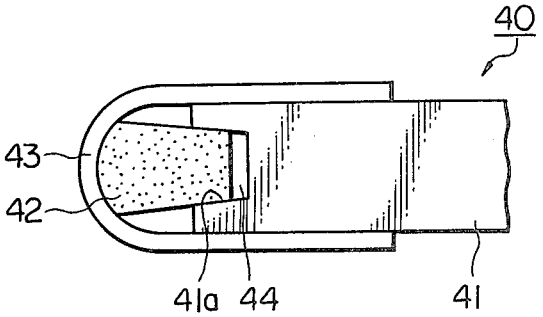

Another embodiment of the piano hammer in accordance with the present invention is shown in FIG. 7, in which an improvement in accordance with the present invention is applied to a piano hammer of the type shown in FIGS. 4A and 4B.

Like the conventional one, the piano hammer 40 comprises a wooden base 41 having an end recess 41*a*, a striking head 42 received in and fixed by bonding to the end recess 41*a* and an outer protective covering 43 fixed to the wooden base 31 while covering the striking head. The mode of assembly of these elements differs from that of the construction shown in FIGS. 4A and 4B in that the end recess 41*a* converges inwardly with a pair of sloping walls, and the striking head 42 converges rearwardly with a pair of sloping surfaces to mate with the above-described sloping walls of the end recess 41*a*. Furthermore a gap 44 is left between the rear end of the striking head 42 and the inner end wall of the end recess 41*a*.

The converging coupling of the striking head 42 with the wooden base 41 effectively absorbs errors in the dimensions of the striking head 42 and/or the end recess 41*a* of the wooden base 41. Only the depth of the gap 44 is caused to vary. In addition, because of the presence of the gap 44, the impact caused by striking of the string does not act on the inner end wall of the end recess 41*a* which tends to develop cracks when an impact is applied thereupon. Thus, the impact force is borne by the pair of sloping walls in contact with the corresponding sloping surfaces of the striking head 42. In this connection, the vector of the impact force is substantially in the longitudinal direction of the piano hammer 40 and the forces acting on the sloping walls of the end recess 41*a* are given in the form of components of the main impact force each of which is smaller than the main impact force due to the convergence of the end recess 41*a*. As a result, loads acting on the contacting surfaces of the wooden base 41 with the striking head 42 can be greatly minimized, which further serves to reduced development of cracks in the wooden base 41.

As in the foregoing embodiment, the head 42 is made of an elastic material such as polyurethane whereas the covering 43 is made of a protective material such as deer-skin or artifical leather.

Figure 8:
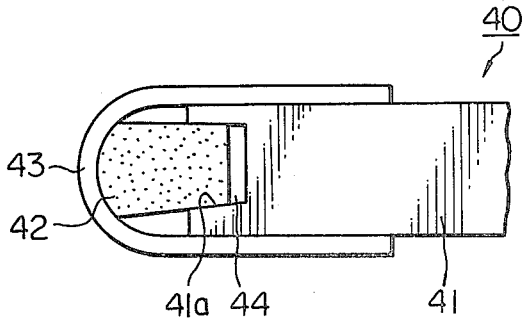

FIG. 8 depicts a variant of the embodiment shown in FIG. 7. Like the foregoing embodiment, the wooden base 41 is provided with an inwardly converging end recess 41*a* and a rearwardly converging striking head 42. In the case of this variant, however, the convergence is formed by one sloping wall of the end recess 41*a* only, the other wall extending substantially parallel to the longitudinal direction of the piano hammer. Likewise, the striking head 42 also has only one sloping surface to mate with the above-described sloping wall of the end recess 41*a*.

What is claimed is:

1. An improved piano hammer, comprising:

a generally elongated base portion, said base portion having an end portion at the end of said hammer with which said hammer strikes, said base portion having a first terminal portion which is shaped and positioned for facing toward a second terminal portion of a striking head, a striking head comprised of an elastic material and located at and being directly secured to said base portion end portion, said striking head having a second terminal portion which faces toward and is in opposition to said base portion first terminal portion, said striking head second terminal portion being at a terminal end of the said direct securement between said striking head and said base portion end portion.

said striking head being shaped and sized such that a refuge gap is normally defined between said first and said second terminal portions, and there is no obstruction in said gap which would prevent said gap from being filled with material of said striking head, and a protective cover disposed over said base portion end portion and also covering said striking head.

2. An improved piano hammer claimed in claim 1 in which said striking head and protective covering are respectively made of polyurethane and of artifical leather.

3. An improved piano hammer as claimed in claim 1, wherein said base portion is comprised of wood.

4. An improved piano hammer, comprising:

a generally elongated base portion, said base portion having an end portion at the end of said hammer with which said hammer strikes, said end portion including a terminal projection with a rounded striking end, on said end portion, but back from said rounded striking end, said base portion having a first terminal portion which is shaped and positioned to face toward and be opposed to a second terminal portion of a striking head, an elongated striking head comprised of elastic material wrapped around and snugly covering said terminal projection, said striking head having a longitudinal end with said second terminal portion which faces toward and is opposed to said first terminal portion, said striking head being so located on said terminal projection that a refuge gap is normally defined between said first and said second terminal portions, and there is no obstruction in said gap which would prevent said gap from being filled with material of said striking head; and a protective cover disposed over said base portion end portion and also covering said striking head and said gap.

5. An improved piano hammer as claimed in claim 4, wherein said base portion is comprised of wood.

6. An improved piano hammer as claimed in claim 5, wherein said terminal projection is U-shaped and said striking head is U-shaped as it wraps around said terminal projection.

7. An improved piano hammer as claimed in claim 4, further comprising, also on said end portion of said base portion and back from said rounded striking end, said end portion having a third terminal portion at the end of said base portion opposite said first terminal portion, said third terminal portion being shaped and positioned to face toward and be opposed to a fourth terminal portion of said striking head, said striking head having at said longitudinal end thereof said fourth terminal portion that is spaced from said second terminal portion of said striking head, said fourth terminal portion facing toward and being opposed to said third terminal portion of said end portion, said striking head being so located on said terminal projection that a second refuge gap is normally defined between said third and said fourth terminal portions and there is no obstruction in said second gap which would prevent said second gap from being filled with material of said striking head; and said protective cover covering both said gaps.

8. An improved piano hammer, comprising:

a generally elongated base portion, said base portion having an end portion at the end of said hammer with which said hammer strikes, said end portion having a depression defined therein and said depression facing in the striking direction of said hammer, said depression having side walls that converge inwardly of said depression, a first terminal portion of said end portion defining the inner end of said depression, a striking head comprised of elastic material and including an end thereof which defines a second terminal portion, said striking portion having a portion thereof which includes said second terminal portion and which is installed in said depression such that said first and said second terminal portions face toward each other and are in opposition;

said striking head being so shaped with respect to said depression that a refuge gap is normally defined between said first and said second terminal portions, a protective cover being disposed over said striking head and over said base portion end portion.

9. An improved piano hammer as claimed in claim 8, wherein said base portion is comprised of wood.

10. An improved piano hammer as claimed in claim 8, wherein said recess converges by having at least one said side wall thereof sloped toward an opposed said side wall thereof.

11. An improved piano hammer as claimed in claim 10, wherein two opposed said side walls are both sloped toward each other.

12. An improved piano hammer as claimed in claim 8, wherein said striking head installed portion has converging side walls which are shaped to matingly engage with said depression side walls.

* * * * *